US005474236A

United States Patent [19]

Davis et al.

[11] Patent Number: 5,474,236

[45] Date of Patent: Dec. 12, 1995

[54] TRANSFER OF ELECTROSTATIC CHARGE TO A ROTARY ATOMIZER HEAD THROUGH THE HOUSING OF A ROTARY ATOMIZING SPRAY DEVICE

[75] Inventors: Dennis Davis, Bay Village; Harold Beam, Oberlin, both of Ohio

[73] Assignee: Nordson Corporation, Westlake, Ohio

[21] Appl. No.: 264,606

[22] Filed: Jun. 23, 1994

Related U.S. Application Data

[63] Continuation-in-part of Ser. No. 171,027, Dec. 21, 1993, Pat. No. 5,346,139, which is a continuation of Ser. No. 985,058, Dec. 3, 1992, abandoned.

[51] Int. Cl.[6] ..... B05D 5/04

[52] U.S. Cl. ..... 239/703; 239/700; 239/223

[58] Field of Search ..... 239/700–703, 239/706, 699, 223, 224, 690, 696, 707

[56] References Cited

U.S. PATENT DOCUMENTS

| | | | |
|---|---|---|---|
| 2,728,607 | 12/1955 | Smart | 239/223 |
| 2,799,532 | 7/1957 | Smart | 43/17 |
| 2,809,902 | 10/1957 | Ransburg | 427/480 |
| 2,989,241 | 6/1961 | Badger | 239/703 |
| 3,009,441 | 11/1961 | Juvinall | 118/624 |
| 3,048,498 | 8/1962 | Juvinall et al. | 427/484 |
| 3,826,425 | 7/1974 | Scharfenberger et al. | 239/15 |
| 3,862,821 | 1/1975 | Vorms et al. | 431/168 |
| 4,037,561 | 7/1977 | LaFave et al. | 118/629 |
| 4,114,564 | 9/1978 | Probst | 118/626 |
| 4,369,924 | 1/1983 | Morishita et al. | 239/703 |
| 4,407,217 | 10/1983 | Jackson | 118/24 |
| 4,422,577 | 12/1983 | Arnold et al. | 239/703 |
| 4,505,430 | 3/1985 | Rodgers et al. | 239/112 |
| 4,555,058 | 11/1985 | Weinstein et al. | 239/223 |
| 4,584,000 | 4/1986 | Guest | 55/73 |
| 4,688,518 | 8/1987 | Missier | 118/626 |
| 4,718,920 | 1/1988 | Kinsey et al. | 55/10 |
| 4,776,520 | 10/1988 | Merritt | 239/700 |
| 4,838,487 | 6/1989 | Schneider | 239/223 |
| 4,852,810 | 8/1989 | Behr et al. | 239/706 |
| 4,854,500 | 8/1989 | Mathai et al. | 239/3 |
| 4,887,770 | 12/1989 | Wacker et al. | 239/703 |
| 4,896,834 | 1/1990 | Coeling et al. | 239/703 |
| 4,943,005 | 7/1990 | Weinstein | 239/223 |
| 4,997,130 | 3/1991 | Weinstein | 239/700 |
| 5,078,321 | 1/1992 | Davis et al. | 239/224 |
| 5,100,057 | 3/1992 | Wacker et al. | 239/223 |
| 5,353,995 | 10/1994 | Chabert | 239/706 |
| 5,358,182 | 10/1994 | Cappeau et al. | 239/703 |

*Primary Examiner*—Andres Kashnikow
*Assistant Examiner*—Lisa Douglas
*Attorney, Agent, or Firm*—Howard M. Cohn

[57] ABSTRACT

A rotary atomizer having a low capacitance, cup-shaped, atomizing head mounted for rotation about an axis of rotation has a coating material flow surface forming a forward cavity. A rotary drive coupled to the atomizing head rotates the atomizing head about the axis of rotation. High voltage electrostatic energy is conducted through the rotary drive directly into the atomizing head whereby changed coating material flows outwardly across the flow surface. In another embodiment, a semi-conductive ring is mounted on the front end of the atomizer to transfer the high voltage electrostatic energy into the atomizing head and/or to dissipate the electrostatic energy in the rotary drive or in the atomizing head.

23 Claims, 3 Drawing Sheets

TRANSFER OF ELECTROSTATIC CHARGE TO A ROTARY ATOMIZER HEAD THROUGH THE HOUSING OF A ROTARY ATOMIZING SPRAY DEVICE

RELATED APPLICATIONS

This application is a continuation-in-part application of U.S. patent application Ser. No. 08/171,027 entitled TRANSFER OF ELECTROSTATIC CHARGE THROUGH A TURBINE DRIVE SHAFT TO A ROTARY ATOMIZER HEAD, filed Dec. 21, 1993, now U.S. Pat. No. 5,346,139, which in turn is a continuation of U.S. Ser. No. 07/985,058 filed Dec. 3, 1992, now abandoned and assigned to the common assignee with the present invention.

FIELD OF THE INVENTION

This invention relates to a rotary atomizer for spraying a liquid coating and more particularly to a rotary atomizer wherein high electrostatic charge is transferred through a turbine drive shaft to a high speed atomizer head secured at one end thereof. An additional embodiment is disclosed wherein high electrostatic charge being transferred to a high speed atomizer head is dissipated within the housing of the rotary atomizer.

BACKGROUND OF THE INVENTION

Rotary atomizers are a type of liquid spray coating device which includes an atomizer head rotatable at high speed (typically 10,000–40,000 revolutions per minute) to apply liquid coating material in atomized form onto the surface of a workpiece. The atomizer head is usually in the form of a disc or cup which includes an interior wall that defines a cavity and terminates in an atomizing edge. Liquid coating material delivered to the interior of the cup migrates outwardly under centrifugal force along the wall of the cup until it is flung from the edge of the cup as atomized coating material. To improve the transfer efficiency of the coating process, an electrostatic charge is imparted to the coating material so that the atomized coating material is attracted to an electrically grounded workpiece. An example of an electrostatically charged rotary atomizer is disclosed in commonly assigned U.S. Pat. No. 4,887,770 ('770) to Wacker et al., which is expressly incorporated herein in its entirety by reference. In the FIG. 12 embodiment of the '770 patent, the cup (20) is made from an insulative material and includes a semi-conductive ring (546) which is charged through posts (504) by three external electrode probes (462). This system suffers from a drawback in that the front end of the housing from which the cup protrudes has a large profile that causes the air currents, generated by the high speed rotation off the cup, to create a vacuum around the front end of the housing which in turn causes the paint to wrap back onto the housing. While this problem has been addressed by directing auxiliary air around the front end of the housing to break up the vacuum, there is a need for an atomizer which does not cause wrap back and does not create a safety hazard.

Prior to the '770 patent, one of the hazards associated with the use of the conductive atomizing cup was the possibility of operator shock or ignition of combustible coatings because of the high voltage at which the cups were maintained. For example, as disclosed in U.S. Pat. No. 4,369,924, charge is transferred through a turbine shaft from a power supply to the rotary atomizer cup. However, both the cup and the entire rotary atomizing housing are metal and are charged to a high voltage. There is a significant safety hazard with this type of construction since the atomizer carries sufficient charge to severely shock an operator. Therefore protective fences and interlocks have to be installed around the atomizer.

The '770 patent, listed before, teaches a low capacitance, rotary atomizer which, while electrostatically charging the coating paint at the rotary atomizer cup, does not store sufficient charge to present a shock hazard and therefore does not have to be protected by fences and safety interlocks. However, since the cup (20) is charged through external electrode probes (462), the system suffers from the drawback that the front end of the housing has a large profile with the attendant problems discussed before.

In another type of rotary atomizer, as disclosed in U.S. Pat. No. 3,826,425, a disk (11) comprised of both insulative and conductive parts, is charged by power supply (21) through cable (22), resistor (23), conductive foam (63), semi-conductive rod (62), semi-conductive ring (61), air gap (39), first semi-conductive plastic rod (24), semi-conductive plug (60), second semi-conductive plastic rod (24) and conductive ink (38). This system suffers from the drawback that the electrical path is made up of a large number of parts which increase the chance of system failure. Also, since the electrical path is spaced outwardly from the rotary shaft, the outer periphery of the front end of the housing has a large profile which causes the paint to wrap back onto the housing.

OBJECTS AND SUMMARY OF THE INVENTION

It is an object of the present invention to provide an apparatus and method for transferring charge through a turbine drive shaft to an atomizer head in a low capacitance type rotary atomizer to obviate the problems and limitations of the prior art systems.

It is another object of the present invention to provide a low capacitance rotary atomizer and method of operation wherein high electrostatic charge being transferred to a high speed atomizer head is dissipated within the housing of the rotary atomizer to obviate the problems and limitations of the prior art systems.

It is a further object of the present invention to provide an apparatus and method for transferring charge through a turbine drive shaft to a high speed atomizer head in a low capacitance type rotary atomizer to reduce the profile of the housing and substantially eliminate wrap back of paint onto the housing.

It is another object of the present invention to provide an apparatus and method for transferring charge through a turbine drive shaft or through the housing of the low capacitance type rotary atomizer to a high speed atomizer head in a low capacitance type rotary atomizer without requiring protective fences and interlocks to be installed around the atomizer to prevent an operator from being shocked by the charge.

It is still a further object of the present invention to provide an apparatus and method for transferring charge to a high speed atomizer head in a low capacitance type rotary atomizer wherein the charge is dissipated within the housing of the rotary atomizer to prevent the need for protecting an operator from being shocked by the charge.

In accordance with the invention, a rotary atomizer comprises a non-electrically conductive housing having a forward end and a rearward end and defining an interior chamber therebetween. A rotary drive device, disposed within the interior chamber and coupled to a cup-shaped, atomizing head located outside of the forward end of the housing, rotates the cup-shaped atomizing head about an axis of rotation extending longitudinally through the housing. Structure is provided for supplying liquid coating material to the cup-shaped, atomizing head. The high voltage electrostatic energy is conducted through the rotary drive device and directly into the cup-shaped, atomizing head without conducting the high voltage electrostatic energy through the housing. The cup-shaped atomizing head is constructed of a composite material including a low capacitance insulating material and electrically conducting material whereby the high voltage electrostatic energy is transmitted from the rotary drive means through the cup-shaped, atomizing head to charge the coating material with high voltage electrostatic energy by contact with at least a part of the electrically conducting material in the atomizing head.

Further in accordance with the invention, the drive device includes an air turbine motor coupled by a drive shaft to the cup-shaped, atomizing head. The drive shaft has a bore aligned with the rotary axis and extending therethrough. A feed tube removably received within the bore is in communication with the atomizing head for supplying liquid coating material to the flow surface of the atomizing head when the atomizing head is rotating about the rotary axis. The motor is mounted in the interior chamber of a motor housing having a forward end and a rearward end and defining the interior chamber therebetween.

In accordance with the invention, the high voltage electrostatic energy is conducted through the rotary drive device by directing high voltage electrostatic energy to the drive shaft for conduction directly therethrough and into the cup-shaped, atomizing head. In one embodiment, the high voltage electrostatic energy is conducted through a feed tube removably received within the bore and in communication with the atomizing head for supplying liquid coating material to the flow surface of the atomizing head. The feed tube conducts the high voltage electrostatic energy into the drive shaft and into the atomizing head. The feed tube has a first end which is engaged with the motor so as to be supported in cantilevered fashion free of electrical contact with the wall of the bore and a second end in close proximity to the atomizing head. In another embodiment, the high voltage electrostatic energy is supplied into the turbine blades of the air turbine motor which in turn transfer the high voltage energy into the drive shaft. The electrostatic energy is transferred into the turbine blades through charging electrodes mounted in close proximity to the turbine blades for transmitting the high voltage energy across a gap into the turbine blades. The charge is then transferred through the drive shaft to the atomizing head. In a third embodiment, the high voltage electrostatic energy is transferred into the drive shaft through the rotary drive device. The rotary drive device includes an element which encircles the drive shaft and transfers the high voltage energy therein for conduction directly therethrough and into the atomizing head. The element encircling the drive shaft is located in closely spaced proximity to the drive shaft whereby the electrostatic energy is transmitted across a gap to the drive shaft. The encircling element is a contact free, bearing device arranged in the motor housing for axially supporting the drive shaft in a non-contact state.

In accordance with the invention, one embodiment of the cup-shaped, atomizing head is constructed of a composite material including an electrically conducting material and a reinforcing material including an electrically non-conducting binder material whereby the coating material is charged with high voltage electrostatic energy from contact with the composite material. The electrically conducting material is about 3 to 8 weight percent of the total weight of the composite and preferably about 5 to 6 weight percent of the total weight of the composite. The reinforcing material is about 20 to 40 weight percent of the total weight of the composite and preferably about 25 to 35 weight percent of the total weight of the composite. The reinforcing material includes an electrically non-conducting binder material having a weight percent of about 65 weight percent of the total weight of the composite.

Also in accordance with the invention, the cup-shaped, atomizing head has a mounting chamber threadedly secured to the drive shaft and a rear cavity disposed between the mounting chamber and a forward cavity having the flow surface. The rear cavity is separated by a divider from the forward cavity. A plurality of holes connect the rear cavity to the forward cavity whereby the coating material delivered to the rear cavity can flow from the rear cavity through the holes to the forward cavity and across flow surface just prior to being expelled from an atomizing edge in a charged state.

In another embodiment, the cup-shaped, atomizing head has charging electrode means embedded in the composite material and extending from the mounting chamber to a flat, circular, ring shaped charging electrode embedded in the flow surface. The charging electrode means is formed of an electrically conductive composite material including electrically non-conducting, binder and electrically conducting materials. The electrically conducting material is about 3 to 15 weight percent of the total weight of the composite and preferably about 6 to 12 weight percent of the total weight of the composite.

In an additional embodiment of the invention, the rotary atomizer comprises a non-electrically conductive housing having a forward end and a rearward end and defining an interior chamber therebetween. A rotary drive disposed within the interior chamber and coupled to a cup-shaped, atomizing head located outside of the forward end of the housing for rotating the cup-shaped atomizing head about an axis of rotation extending longitudinally through the housing. Liquid coating material is supplied to the cup-shaped, atomizing head. High voltage electrostatic energy is conducted through the rotary drive means and directly into the cup-shaped, atomizing head without conducting the high voltage electrostatic energy through the housing. A cup-shaped atomizing head is constructed of a composite material including a low capacitance insulating material and electrically conducting material whereby the high voltage electrostatic energy is transmitted from the rotary drive through the cup-shaped, atomizing head to charge the coating material with high voltage electrostatic energy by contact with at least a part of the electrically conducting material in the atomizing head.

Also, in accordance with the invention, the rotary atomizer includes an atomizer housing having a forward end and a rearward end and a semi-conductive ring having a central bore therethrough mounted to the forward end of the atomizer housing. The rotary drive extends longitudinally through the interior chamber of the housing and is coupled at one end to an atomizing head which projects outward from the central bore of the semi-conductive ring and is spaced therefrom to form an air gap therebetween. A circuit transfers a high voltage electrostatic charge through the atomizer housing and into the atomizing head. The semi-conductive ring and the atomizing head are both being constructed of a semiconductive composite material including a low capacitance insulating material and an electrically conducting material whereby the high voltage electrostatic charge in the atomizing head can jump across the air gap to be dissipated within the ring.

Also in accordance with the invention, the high voltage electrostatic charge can be transferred into the atomizing head through various means including through the rotary drive or by means of a resistor mounted in the atomizer housing and connected at one end to the semi-conductive ring and to the other end to a source of high voltage electrostatic charge disposed either in or external to the housing.

BRIEF DESCRIPTION OF THE DRAWINGS

The structure, operation, and advantages of the presently preferred embodiment of the invention will become further apparent upon consideration of the following description taken in conjunction with the accompanying drawings, wherein.

DETAILED DESCRIPTION OF THE INVENTION

Figure 1:
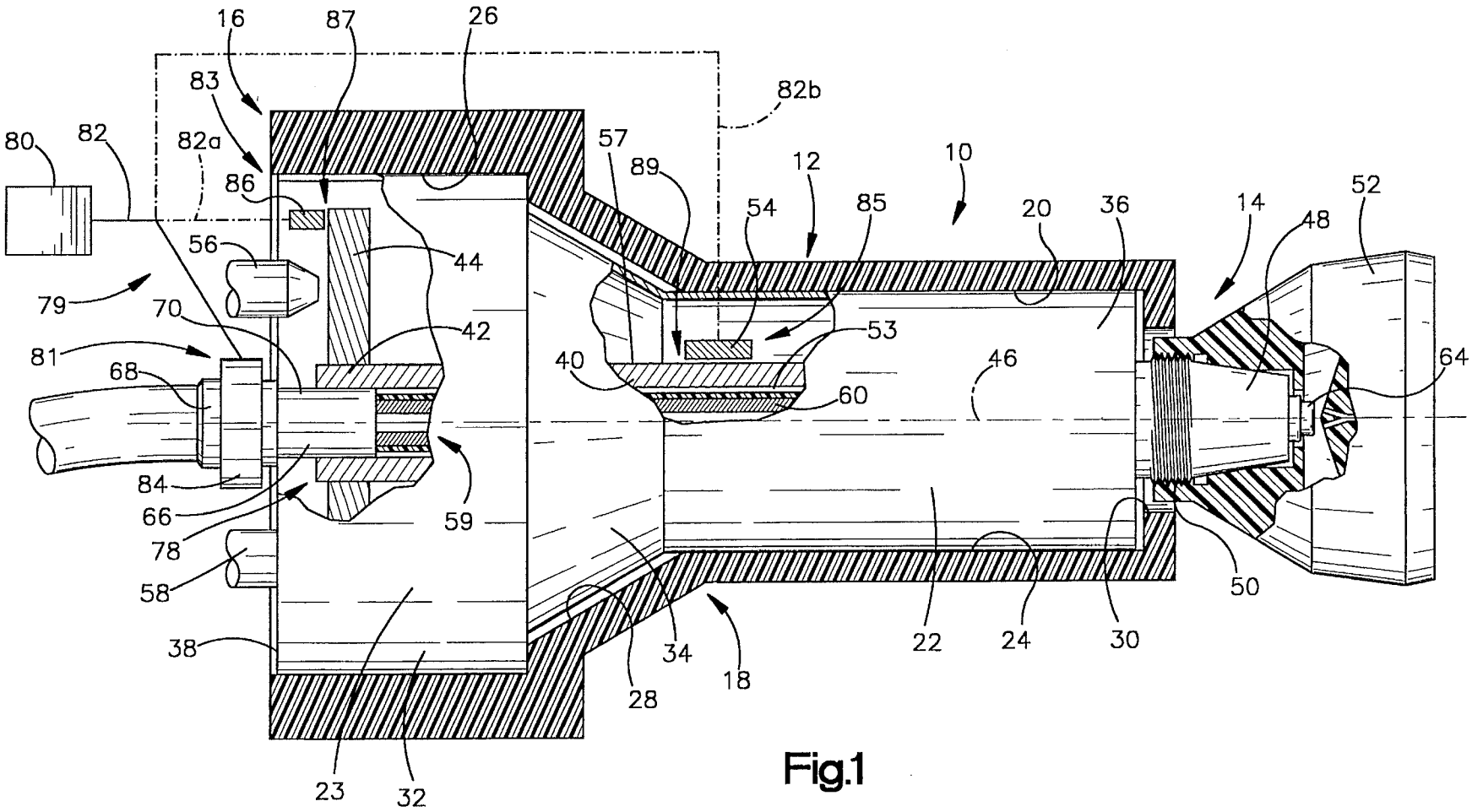
FIG. 1 is a partial longitudinal, cross sectional view of a rotary atomizer illustrating several alternative means of supplying charge to be transferred through the turbine drive shaft to the cup in accordance with the present invention.

Referring to FIG. 1, a rotary atomizer 10 constructed in accordance with the invention is shown. Atomizer 10 includes a motor housing 12, preferably formed of an electrically, non-conductive material, with a forward end 14, a rearward end 16 and an intermediate section 18 defining an interior chamber 20 in which a rotary drive device 22 is mounted. The interior chamber 20 is defined by a first cylindrical bore 24, a second cylindrical bore 26 of a larger diameter then the first cylindrical bore and a frustro-conical bore 28 interconnecting the first and second bores 24, 26. Forward end 14 has a through bore 30 opening into first cylindrical bore 24 of chamber 20. Rearward end 16 opens into second cylindrical bore 26 of chamber 20. The motor housing 12 can be attached by any conventional means (not shown) to a fixed support or to a movable support such as a robot.

The rotary drive device 22 includes an air turbine motor 23 having a cylindrically shaped rear section 32 disposed in the cylindrical bore 26, a frustro conically shaped intermediate section 34 received within frustro-conical bore 28 and a cylindrically shaped front section 36 received within first cylindrical bore 24. Motor 23 is secured within interior chamber 20 by conventional means such as one or more clamps (not shown) which are connected to the rearward end 16 of housing 12 and the base 38 of motor 23.

A motor drive shaft 40, connected at a first end 42 to turbine blades 44 disposed in the rear section 32 of motor 23, extends forward along an axis 46 of rotation to traverse the entire length of motor 23 so that the opposite second end 48 of drive shaft 40 projects outward from through bore 30 of housing 12. The second end 48 has a threaded section 50 and a frustro-conically shaped end adapted to securely receive a cup shaped, rotary atomizer head 52. Motor drive shaft 40 has a through bore 53 which is aligned with axis 46 and extends the length of the drive shaft. The external surface 57 and the internal surface of bore 53 of drive shaft 40 can be coated with an electrically non-conductive material 55, such as for example a polymeric material (the coating on internal surface not being illustrated). The area of the external surface 53 of drive shaft 40 which is in contact with an adjacent element through which high voltage energy is transferred, is free of the coating material.

Motor 23 preferably comprises an air driven type turbine which includes internal air bearings 54, a driving air inlet 56 and a braking air inlet 58 for controlling the rotational speed of head 52, all of which components are well known in the art.

A device or means 59 for supplying coating material includes a removable coating material feed tube 60 which extends the length of throughbore 43. Tube 60 has a first end 62 which communicates with the interior of atomizer head 52 and which preferably carries a removable nozzle 64 and an opposed second end 66 having a female fluid coupling 68. Coupling 68 has a base 70 which is frictionally and removably received (not shown) within the base 38 of motor 23. When engaged within the base of motor 23, feed tube 60 is supported in cantilever fashion free of contact from the wall of bore 53, as disclosed in commonly assigned U.S. Pat. No. 5,100,057 ('057) to Wacker et al., which is expressly incorporated herein in its entirety by reference. As further disclosed in commonly assigned U.S. Pat. No. 5,078,321 ('321) to Wacker et al., which is expressly incorporated herein in its entirety by reference, feed tube 60 preferably has a first portion 72 formed of a rigid electrically conductive material, a second portion 74 formed of an electrically non-conductive material and a covering layer 76 of heat shrinkable, non-conductive material. Alternatively, the feed tube 60 could be made of conductive material, such as stainless steel. As with the drive shaft 40, the external surface of feed tube 60 can be coated with an electrically non-conductive material, such as for example a polymeric material, as required.

Figure 2:
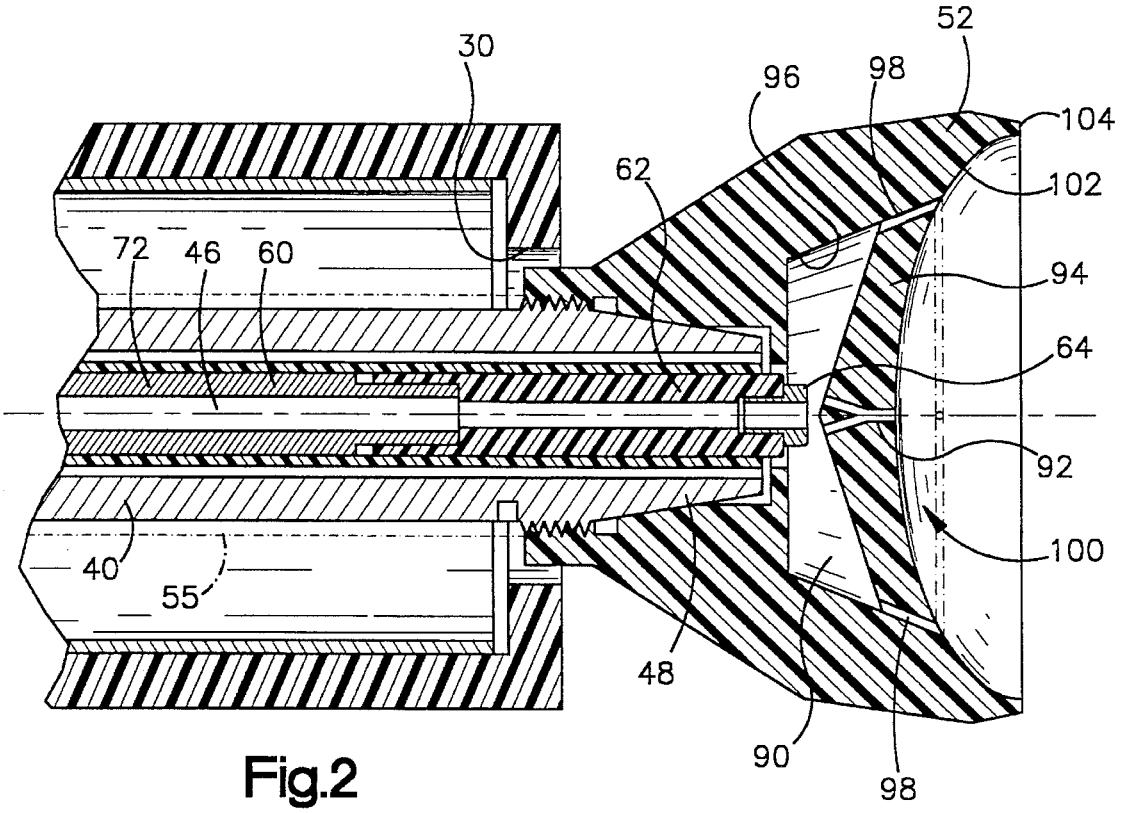
FIG. 2 is a partial longitudinal, cross sectional view showing the forward end of a first embodiment of the rotary atomizer of FIG. 1 in further detail.

Referring now to FIGS. 1 and 2, an important aspect of this invention is the means 78 for conducting high voltage electrostatic energy through the rotary drive means 22 and directly into cup-shaped, atomizing head 52 secured to the second end 48 of drive shaft 40. The means 78 for conducting high voltage energy includes means 79 for supplying high voltage energy to the drive shaft 40 for conduction directly therethrough and into the atomizing head 52. Means 79 includes an external high voltage generator 80 used for generating high voltage electrostatic energy.

In one embodiment, means 79 for supplying high voltage energy includes means 81 for directing an electrical charge into a feed tube 60 removably received within the bore 53. Means 81 includes a line 82 connecting an externally located high voltage generator 80 to a terminal 84 attached to the second end 66 of feed tube 60, such as a collar secured about coupling 68. In this embodiment, the high voltage electrostatic energy is transmitted to the cup-shaped, atomizing head 52, as described in more detail below, via the second end 66 of tube 60 which is in direct contact with motor drive shaft 40. While high voltage generator 80 is preferably located externally from the motor housing 12, it is within the terms of the invention to locate generator 80 internally of housing 12.

In an alternative embodiment, means 79 for supplying high voltage electrostatic energy through the drive shaft 40 includes means 83 for directing high voltage electrical energy into turbine blades 44 of the air turbine motor 23 which in turn conducts the high voltage energy into the drive shaft 40. Means 83 for directing high voltage electrical energy includes a power line 82A connecting external high voltage generator 80 to an electrode 86 which is disposed in close proximity to the turbine blades 44 so as to form a narrow air gap 87. The electrostatic energy is transferred from line 82A, across air gap 87 to turbine blades 44, into the motor drive shaft 40 and ultimately into atomizing head 52, as described in more detail below.

In another alternative embodiment, means 79 for supplying high voltage electrostatic energy includes means 85 encircling drive shaft 40 for directing the high voltage electrostatic energy into drive shaft 40 and directly therethrough and into the cup-shaped, atomizing head 52. Means 85 includes a power line 82B connecting external high voltage generator 80 to air bearing 54 which is disposed in-close proximity to motor drive shaft 40 to form a gap 89. The electrostatic energy is transmitted from line 82B, across gap 89 to drive shaft 40 and ultimately into atomizing head 52, as described in more detail below. For a detailed description of a suitable air bearing 54 used in the rotary atomizer 10 of FIG. 1, see FIG. 1 and column 4, lines 30–60 of the U.S. Pat. No. 4,369,924 to Morishita et al., which is expressly incorporated herein by reference.

Figure 3:
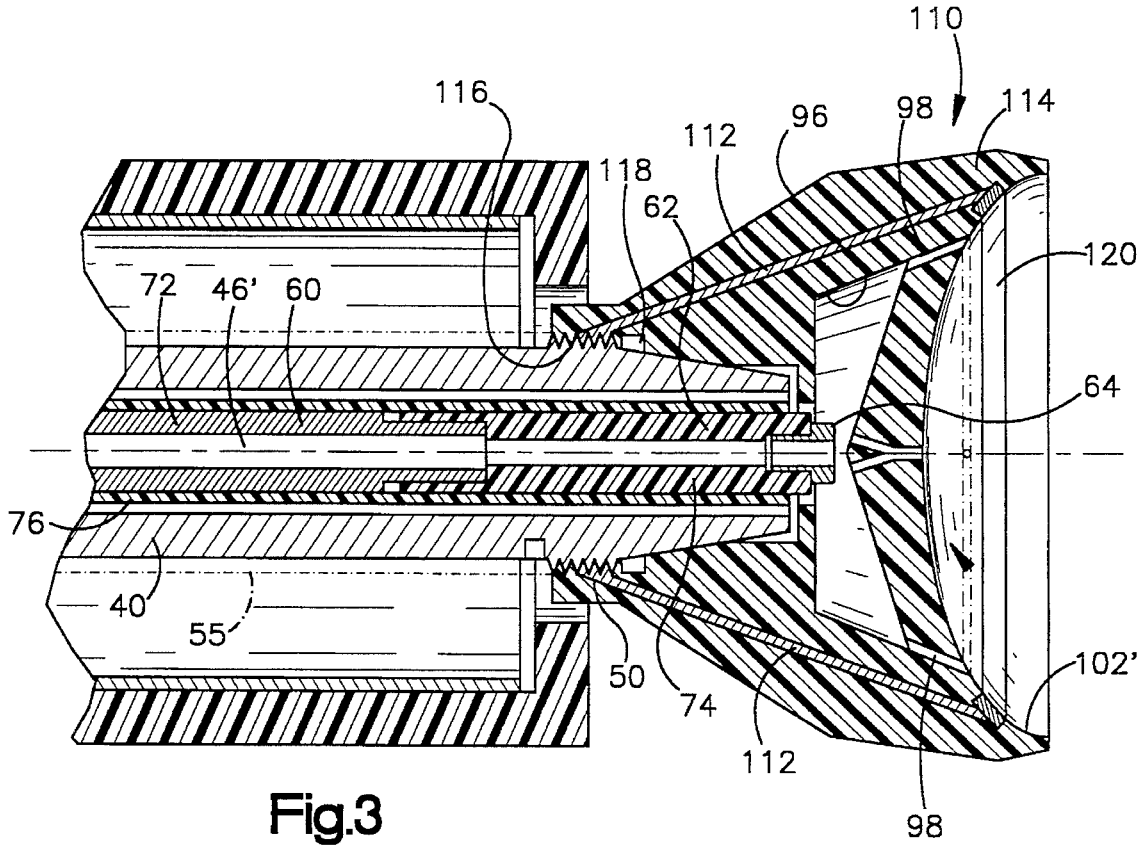
FIG. 3 is a partial longitudinal, cross sectional view showing the forward end of a second embodiment of the rotary atomizer of FIG. 1 in further detail.

The atomizer head 52 is threaded onto the end of rotary drive shaft 40, as illustrated in FIGS. 1–3. For a detailed description of a suitable atomizer head 52 used in the rotary atomizer 10, see FIG. 1 and column 4, line 57, column 5, line 29 of the '321 patent listed above. Atomizer head 52, as illustrated in FIG. 2, is uniformly constructed of a composite material including a low capacitance insulating material and an electrically conducting material.

The low capacitance insulating material is a non-conducting, reinforcing material selected to provide the composite with the desired mechanical properties such as good impact and tensile strength and dimensional stability. Further, the low capacitance insulating material includes the properties of heat and electrical resistance and chemical and mechanical resistance to the action of the ingredients of the coating material. A preferred type of reinforcing insulating material is glass fiber but other organic or synthetic fibers can be used. The total weight percent of the reinforcing material to the total weight of the composite is about 20 to 40 weight percent and preferably about 25 to 35 weight percent and most preferably about 30 weight percent. The weight percent of the reinforcing material can be varied as long as the reinforcing material performs its intended function.

The binder material should possess such properties as good heat and electrical resistance and good chemical and mechanical resistance to the action of the ingredients of the coating material. A polymeric material such as PEEK (polyetheretherketone) available from I.C.I. of America is suitable. The total weight percent of the binder material to the total weight of the composite is about 65 weight percent. The weight percent of the binder material can be varied as long as the binder material performs its intended function.

The electrically conducting material is a carbon containing material, and more particularly a carbon fiber, however other electrically conducting materials such as carbon black or particulate graphite can be used. The weight percent of carbon fiber in the head 52 is selected to provide a desired resistivity. A suitable weight percentage of carbon fiber to the total weight of the composite is about 3 to 8 weight percent, and preferably about 5 to 6 weight percent of the total weight of the composite. Composites containing more than about 8 percent by weight carbon fiber appear to be too conducting, whereas composites containing less than about 3 percent by weight of carbon fiber appear to be too non-conducting.

In operation, head 52 is rotated at high speed in response to the air pressure applied to driving air inlet 56 and braking air inlet 58. Concurrently with the rotation of head 52, high voltage electrostatic energy is conducted through the rotary drive means 22 directly into atomizing head 52 secured to the second end 48 of drive shaft 40. The electrostatic energy is transferred from the high voltage generator 80 to drive shaft 40 and ultimately into atomizing head 52, in accordance with principles described before. While the electrostatic energy is preferably conducted from the second end 48 of drive shaft 40 into the head 52 via the threaded section 50, it is also within the terms of the invention to conduct the electrostatic energy across the frustro-conically shaped end onto which the cup shaped, rotary atomizer head 52 is securely attached.

To commence spraying, the fluid material applied to the feed tube 60, flows through nozzle 64 and into cup-shaped, atomizing head 52, see FIG. 3 and column 12, line 60 through column 13, line 30 of the '057 patent listed above. The fluid material then flows into the rear cavity 90 of head 52, as shown in FIG. 2. Then, a small amount of the liquid flows through opening 92 provided in the divider 94 to maintain the forward surface of divider 94 in a wetted condition. The majority of the coating material, however, is forced along wall 96 due to centrifugal force and caused to migrate along wall 96 outwardly through holes 98 into the forward header cavity 100. Then the coating material flows across flow surface 102 just prior to being expelled from atomizing edge 104 to effect atomization. Throughout the contact of the coating material with the surfaces of header 52, electrostatic charge is imparted to the coating material. The resulting cloud of charged coating material is propelled forward toward a workpiece.

Since the electrostatic charge is conducted through drive shaft 40, in accordance with the principles of the present invention, the motor housing 12 can be constructed with forward end 12 disposed coincident with centerline 46 and having a diameter which is less than the diameter of the atomizing edge 104 of rotary head 52. The effect of this relationship, i.e., the profile of the motor housing to the rotary head, is the substantial eliminations of the wrap back of paint onto the motor housing. The heads 52 and 110, as illustrated in FIGS. 2 & 3, have their threaded sections at the base of the head partially disposed within the opening 30. Since drive shaft 40 is typically coated with an electrically non-conductive material, the charge can be transferred through drive shaft 40 to the head in a low capacitance type rotary atomizer without requiring protective fences and interlocks to be installed around the atomizer to prevent an operator from being shocked by the charge. Another advantage of the improved motor housing design, as disclosed herein, is the light weight of the improved rotary and its ability to be easily adapted for automatic control by a robot.

While the above described embodiments of the invention provide a very effective means of transferring charge through a turbine drive shaft 40 to a rotary head 52 and then to coating material, it is also within the terms of the invention to provide an alternative embodiment wherein rotary atomizer head 52 is replaced with an alternative rotary atomizer head 110, as illustrated in FIG. 3. The head 110 is generally constructed of a composite material including a low capacitance insulating material and an electrically non-conducting binder material of the types described in the embodiment illustrated in FIG. 2. The head 110 includes a plurality of equally spaced, rod shaped charging electrodes 112 embedded in the wall 114 and extending from the threaded surface 116 of the mounting chamber 118 to a flat, circular, ring shaped charging electrode 120 embedded in the wall 114 and forming a portion of the flow surface 102'. Throughout the specification, primed and double primed numbers represent structural elements which are substantially identical to structural elements represented by the same unprimed number. Both the rod shaped and ring shaped charging electrodes 112,120 are formed of an electrically conductive composite material including non-conducting, insulative binder and electrically conducting materials of the type used in the rotary head 52, as described before. In the preferred embodiment, the insulative material can be PEEK and the electrically conducting material can be carbon fibers. A suitable weight percentage of carbon fiber to the total weight of the composite is about 3 to 8 weight percent, and preferably about 5 to 6 weight percent of the total weight of the composite. Composites containing more than about 8 percent by weight carbon fiber appear to be too conducting, whereas composites containing less than about 3 percent by weight of carbon fiber appear to be too non-conducting. While a plurality of rod shaped charging electrodes 112 are preferred, it is within the terms of the invention to substitute a frustro-conically shaped charging electrode embedded in the wall 114 and extending from the threaded surface 116 of the mounting chamber 118 to flat, circular, ring shaped charging electrode 120.

The operation of the embodiment illustrated in FIG. 3 is essentially identical to the operation of the embodiment illustrated in FIG. 2 except that the electrostatic energy is directed from the high voltage generator 80 to drive shaft 40 and ultimately into atomizing head 52 via the threaded section 50 and the threaded surface 116. Then the electrostatic energy is directed into the rod shaped electrodes 112 and ring shaped electrode 120 to be imparted into coating material flowing over the surface 102' in the manner shown in the '770 patent listed before. This embodiment is particularly advantageous because the electrically non-conducting composite forming the head and the electrically conductive composite material forming the conductor rods and ring are similar in physical characteristics and do not have a tendency to separate under operating conditions, as was sometimes the case with the prior art atomizing heads.

Figure 4:
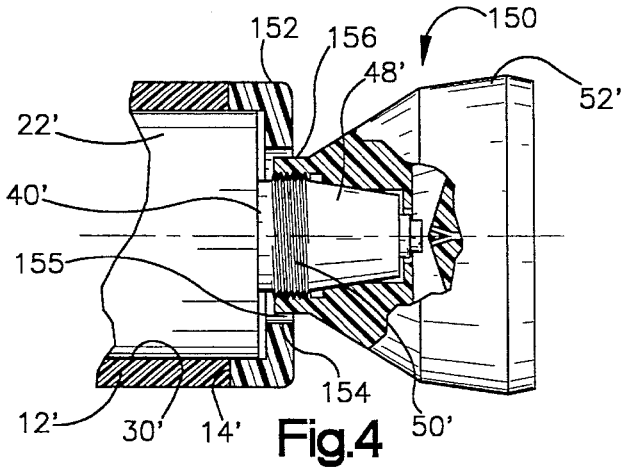
FIG. 4 is a side view, partially in cross section, of a modified front end of the rotary atomizer shown in FIG. 1, wherein a semi-conductive ring is disposed at the front end of the atomizer housing for dissipating high electrostatic charge being transferred to a high speed atomizer head through the turbine drive shaft.

While the embodiments described hereinbefore can effectively transfer charge through a turbine drive shaft of a low capacitance type rotary atomizer to a high speed atomizer head, there is also disclosed herein a low capacitance type rotary atomizer 150, as shown in FIG. 4, which is substantially identical to rotary atomizer 10 except for a ring 152 mounted to the forward end 14' of motor housing 12' of a rotary drive device 22'. Ring 152 has a central bore 154 through which second end 48' of drive shaft 40' projects outward from through bore 30' of housing 12'. The second end 48' has a threaded section 50' and a frustro-conically shaped end to which a cup shaped, rotary atomizer head 52' is secured. A narrow air gap 155 between about 0.010 and about 0.020 inches and preferably between about 0.015 inches is located between the rear circular surface 156 of head 52' and the circular wall of bore 154.

An important feature of ring 152 is its construction from a semi-conductive composite material having a volume resistivity of about $10^7$ to about $10^{11}$ ohm-cm and preferably about $10^9$ ohm-cm. The semi-conductive composite material includes a low capacitance insulating material and an electrically conducting material substantially identical with the type of materials used to construct atomizer head 52'. That is, the low capacitance insulating material is a non-conducting, reinforcing material selected to provide the composite with the desired mechanical properties such as good impact and tensile strength and dimensional stability. Further, the low capacitance insulating material includes the properties of heat, electrical, chemical and mechanical resistance to the action of the ingredients of the coating material. A preferred type of reinforcing insulating material is glass fiber but other organic or synthetic fibers can be used. The total weight percent of the reinforcing material to the total weight of the composite is about 20 to 40 weight percent and preferably about 25 to 35 weight percent and most preferably about 30 weight percent. The weight percent of the reinforcing material can be varied as long as the reinforcing material performs its intended function.

The binder material should possess such properties as good heat and electrical resistance and good chemical and mechanical resistance to the action of the ingredients of the coating material. A polymeric material such as PEEK (polyetheretherketone) or PPS (polyfhenylene sulfide) is suitable. The total weight percent of the binder material to the total weight of the composite is about 65 weight percent. The weight percent of the binder material can be varied as long as the binder material performs its intended function.

The electrically conducting material is a carbon containing material, and more particularly a carbon fiber, however other electrically conducting materials such as carbon black or particulate graphite can be used. The weight percent of carbon fiber in ring 152 is selected to provide a desired resistivity, generally the same as that of head 52. A suitable weight percentage of carbon fiber to the total weight of the composite is about 3 to 15 weight percent, and preferably about 6 to 12 weight percent of the total weight of the composite. Composites containing more than about 15 percent by weight carbon fiber appear to be too conducting, whereas composites containing less than about 3 percent by weight of carbon fiber appear to be too non-conducting.

In operation, the high voltage electrostatic energy is transferred from a high voltage generator (not shown) to drive shaft 40' of rotary drive 22' and directly into atomizing head 52' secured to the second end 48' of drive shaft 40'. The entire atomizing head 52', being constructed of a composite material including a low capacitance insulating material and an electrically conducting material, is then charged. If an operator were to accidently touch head 52' or ring 152, a slight discharge and possibly a small spark could then be felt but no injury would be sustained. Moreover, if a conductor, such as a metal strip, were placed near gap 155 between the bore 154 and the rear surface 156 of head 52', the high electrostatic charge in shaft 40' which would otherwise create a long powerful spark, would dissipate in semi-conductive ring 152 and create a weak discharge and possibly small spark which would not injure an operator.

Figure 5:
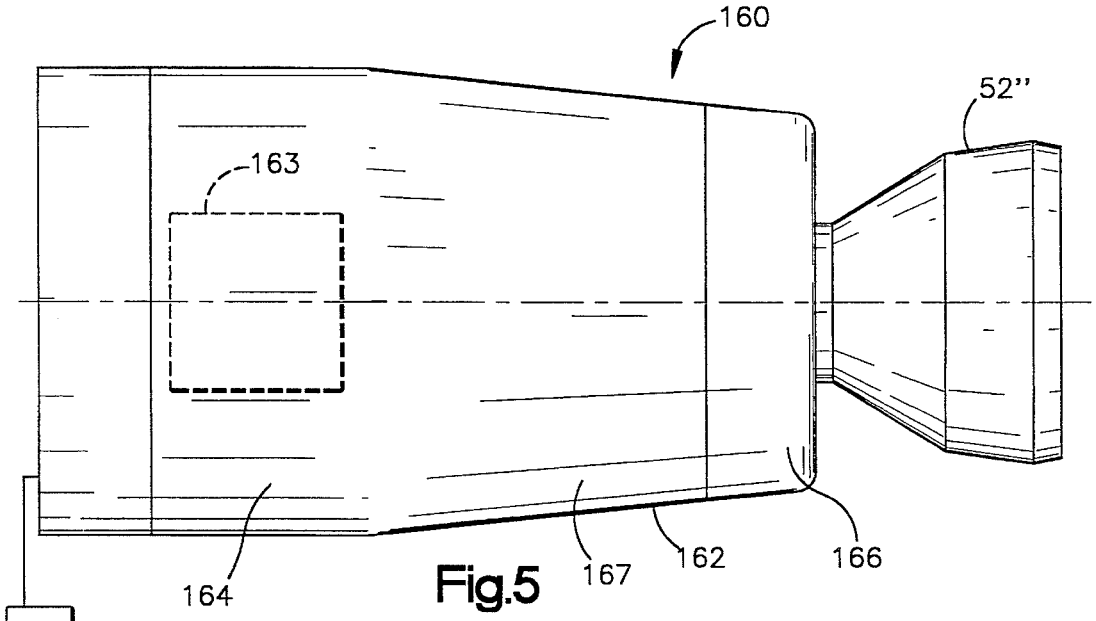
FIG. 5 is a side view of another embodiment of a rotary atomizer wherein a semi-conductive ring is disposed at the front end of the atomizer housing for dissipating high electrostatic charge being transferred to a high speed atomizer head.
Figure 6:
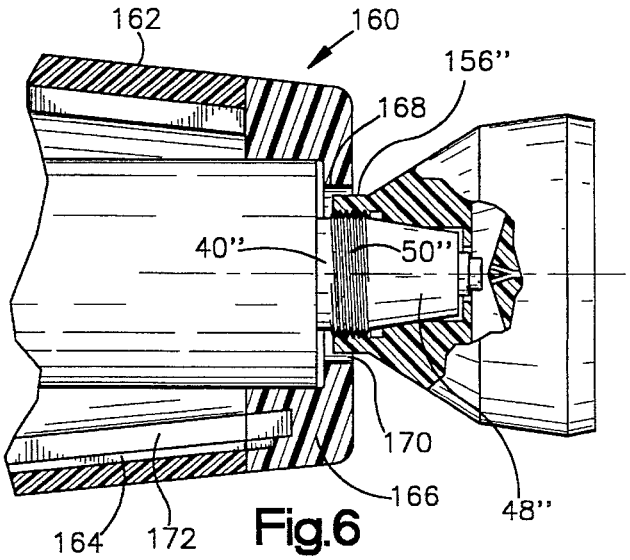
FIG. 6 is a partial longitudinal, cross sectional view showing the forward end of the embodiment of FIG. 5 including a resistor for transferring high electrostatic charge to a high speed atomizer head via a semi-conductive ring disposed at the front end of the atomizer housing.

According to the invention, another embodiment of a rotary atomizer 160 is schematically illustrated in FIG. 5. The atomizer housing 162, as shown in FIGS. 5 and 6, has a rear cylindrical section 164, a frustro-conical intermediate section 167 and a ring 166 mounted to the end of intermediate section 167. Ring 166 has a central bore 168 through which end 48" of drive shaft 40" projects outward from through bore 168 of ring 166. End 48" has a threaded section 50" and a frustro-conically shaped end to which a rotary atomizer head 52" is secured. A narrow air gap 170 between about 0.010 and about 0.020 inches and preferably between about 0.013 inches is located between the rear circular surface 156" of head 52" and the circular wall of bore 168.

While housing 162 is typically constructed of a non-electrically conductive material, such as for example plastic, ring 166 can be constructed of a semi-conductive composite material including a low capacitance insulating material and an electrically conducting material substantially identical with the material used to construct ring 152 of FIG. 4. A resistor 172 with a value, for example of between about $200\times10^6$ to about $500\times10^6$ ohm and preferably about $300\times10^6$ ohm, is connected at one end to an internal power source 163 or an external power source 165 to housing 162 and at the other end to ring 166. In the embodiment shown, resistor 172 is secured within a bore 174 within ring 166.

In operation, the high voltage electrostatic energy is transferred from high voltage generator through resistor 172 and into ring 166. Then, the charge jumps across air gap 170 and into atomizing head 52" secured to the second end 48" of drive shaft 40". The atomizing head 52" being constructed of substantially the same composite material as ring 166, i.e., low capacitance insulating material and an electrically conducting material, is then charged. Concurrently, the drive shaft 40" is also charged. If an operator were to accidently touch head 52" or ring 166, the discharge or weak spark could then be felt but no injury would be sustained since the high electrostatic charge would be dissipated in semi-conductive ring 166. Further, if a conductor, such as a metal strip, were placed near gap 155 between the bore 154 and the rear surface 156 of head 52', the high electrostatic charge in shaft 40' which would otherwise create a long powerful spark, would dissipate in semi-conductive ring 152 and create a weak discharge and possibly a small spark which would not injure an operator.

While rotary atomizer 160 is described as being constructed of a non-electrically conductive material with a ring 166 constructed of a semi-conductive composite material including a low capacitance insulating material and an electrically conducting material, it is also within the terms of the invention to construct the entire rotary housing 162 of the semi-conductive composite material used to construct ring 152 of FIG. 4.

It is apparent that there has been provided in accordance with this invention an apparatus and method for transferring high electrostatic charge through a turbine drive shaft to a high speed rotary head of a rotary atomizer that satisfies the objects, means and advantages set forth hereinbefore. The apparatus and method includes several means of transferring high voltage electrostatic energy into the rotary head, such as through the motor drive shaft or through a ring mounted to the front end of the atomizer housing. Several important advantages result including a reduction in the profile of the housing to substantially eliminate wrap back of paint onto the housing and dissipation of the charge in the semiconductive ring to prevent the formation of a strong spark between a conductor and the drive shaft. Further, several embodiments of rotary head construction provide long lasting, effective means for transferring charge into the coating material.

While the invention has been described in combination with embodiments thereof, it is evident that many alternatives, modifications, and variations will be apparent to those skilled in the art in light of the foregoing description. Accordingly, the invention is intended to embrace all such alternatives, modifications and variations as fall within the spirit and scope of the appended claims.

We claim:

1. A rotary atomizer, comprising:

an atomizer housing having a forward end and a rearward end which define an interior chamber therebetween;

a semi-conductive ring having a central bore therethrough mounted to said forward end of said atomizer housing;

a rotary drive extending longitudinally through said interior chamber of said housing and coupled at one end to an atomizing head whereby said atomizing head projects outward from said central bore of said semi-conductive ring and is spaced from said semi-conductive ring to form an air gap therebetween;

a circuit for transferring a high voltage electrostatic charge through said atomizer housing into said atomizing head; and said semi-conductive ring being constructed of a semi-conductive composite material so that said high voltage electrostatic charge being transferred into said atomizing head is transfered across said air gap between said semi-conductive ring and said atomizing head.

2. The rotary atomizer of claim 1 wherein said rotary drive forms a portion of said circuit and includes a drive shaft through which said high voltage electrostatic charge is transferred into said atomizing head, said drive shaft having a first end extending through said central bore of said semi-conductive ring, said first end of said drive shaft having said atomizing head secured thereto whereby said high voltage electrostatic charge being transferred through said drive shaft and into said atomizing head is transferred from said drive shaft across said air gap and into said semi-conductive ring.

3. The rotary atomizer of claim 1 wherein said atomizing head is constructed of said semiconductive composite material.

4. The rotary atomizer of claim 3 wherein said semiconductive composite material includes a low capacitance insulating material and an electrically conducting material.

5. The rotary atomizer of claim 4 wherein said semiconductive composite material includes a low capacitance insulating material comprising a non-conducting, reinforcing material having a total weight percent of the reinforcing material to the total weight of the composite being about 20 to 40 weight percent, a binder material having a total weight percent of the binder material to the total weight of the composite being about 65 weight percent, and an electrically conducting material being a carbon containing material having a weight percentage of about 3 to 15 weight percent of carbon fiber to the total weight of the composite.

6. The rotary atomizer of claim 1 wherein said atomizer housing is constructed of an electrically non-conductive material.

7. The rotary atomizer of claim 1 wherein said atomizer housing is constructed of a semi-conductive material.

8. The rotary atomizer of claim 2 wherein said rotary drive includes an air turbine motor coupled to a second end of said drive shaft for rotating said atomizing head.

9. The rotary atomizer of claim 8 wherein said liquid coating material is supplied to said atomizing head through a feed tube being removably received within an elongated bore extending through said drive shaft and being in communication with said atomizing head for supplying liquid coating material to said atomizing head when said atomizing head is rotating.

10. The rotary atomizer of claim 9 wherein said atomizing head has a coating material flow surface forming a forward cavity whereby coating material flows outwardly across said flow surface and is flung radially outward to form atomized particles of charged coating material adapted for application to a workpiece.

11. The rotary atomizer of claim 1 wherein said circuit transfers electrostatic charge through said semi-conductive ring and across said air gap into said atomizing head.

12. A rotary atomizer, comprising:

an atomizer housing having a forward end and a rearward end which define an interior chamber therebetween;

a semi-conductive ring having a central bore therethrough mounted to said forward end of said atomizer housing;

a rotary drive extending longitudinally through said interior chamber of said atomizer housing and coupled at one end to an atomizing head whereby said atomizing head projects outward from said central bore of said semi-conductive ring and is spaced from said semi-conductive ring to form an air gap therebetween; and a circuit for transferring a high voltage electrostatic charge through said semi-conductive ring and across said air gap into said atomizing head, said semi-conductive ring being constructed of a semiconductive composite material.

13. The rotary atomizer of claim 12 wherein said circuit includes a resistor mounted in said atomizer housing and connected to said semi-conductive ring for transferring said high voltage electrostatic charge from a source of charge into said semi-conductive ring.

14. The rotary atomizer of claim 13 wherein said source of high voltage electrostatic charge is mounted external to said atomizer housing and is connected to said resistor to transfer said high voltage electrostatic charge from said source of charge to said semi-conductive ring.

15. The rotary atomizer of claim 14 wherein said source of high voltage electrostatic charge is mounted internal to said atomizer housing and is connected to said resistor to transfer said high voltage electrostatic charge from said source of charge to said semi-conductive ring.

16. The rotary atomizer of claim 12 wherein said atomizing head is constructed of said semiconductive composite material.

17. The rotary atomizer of claim 16 wherein said semi-conductive composite material including a low capacitance insulating material and an electrically conducting material.

18. The rotary atomizer of claim 17 wherein said semi-conductive composite material includes a low capacitance insulating material comprising a non-conducting, reinforcing material having a total weight percent of the reinforcing material to the total weight of the composite being about 20 to 40 weight percent, a binder material having a total weight percent of the binder material to the total weight of the composite being about 65 weight percent, and an electrically conducting material being a carbon containing material having a weight percentage of about 3 to 15 percent of carbon fiber to the total weight of the composite.

19. The rotary atomizer of claim 12 wherein said atomizer housing is constructed of an electrically non-conductive material.

20. The rotary atomizer of claim 12 wherein said atomizer housing is constructed of a semi-conductive material.

21. The rotary atomizer of claim 12 wherein said rotary drive includes an air turbine motor coupled to a second end of said drive shaft for rotating said atomizing head.

22. The rotary atomizer of claim 21 wherein said liquid coating material is supplied to said atomizing head through a feed tube being removably received within an elongated bore extending through said drive shaft and being in communication with said atomizing head for supplying liquid coating material to said atomizing head when said atomizing head is rotating.

23. The rotary atomizer of claim 22 wherein said atomizing head has a coating material flow surface forming a forward cavity whereby coating material flows outwardly across said flow surface and is flung radially outward to form atomized particles of charged coating material.

* * * * *